US006443410B1

(12) United States Patent
Lee

(10) Patent No.: US 6,443,410 B1
(45) Date of Patent: Sep. 3, 2002

(54) CORNER CONNECTOR FOR GARMENT RACKS

(75) Inventor: James Lee, Saddle Brook, NJ (US)

(73) Assignee: Organize It All, Saddle Brook, NJ (US)

( * ) Notice: Subject to any disclaimer, the term of this patent is extended or adjusted under 35 U.S.C. 154(b) by 0 days.

(21) Appl. No.: 09/495,972

(22) Filed: Feb. 2, 2000

(51) Int. Cl.[7] ..... A47G 29/02; E04G 3/08

(52) U.S. Cl. ..... 248/235; 248/250; 211/182; 403/347

(58) Field of Search ..... 248/126, 229.16, 248/536, 540, 250, 121, 158, 235, 243; 211/204, 195, 206, 208, 177, 182; D6/411; 403/347, 292, 300, 308; 252/11, 2, 3

(56) References Cited

U.S. PATENT DOCUMENTS 1,440,852 A * 1/1923 Thomson ..... 256/11
1,790,798 A * 2/1931 Davis ..... 211/182
2,533,324 A * 12/1950 Mendle ..... 211/206
D164,500 S 9/1951 Ives
3,144,946 A * 8/1964 Ellis ..... 211/182
D215,726 S * 10/1969 Skibowski ..... D25/134
3,503,525 A * 3/1970 Loebner ..... 211/206
3,698,691 A * 10/1972 Brown ..... 256/11
D304,528 S 11/1989 Handler et al.
D316,342 S 4/1991 Kee
D406,484 S 3/1999 Wu
6,099,001 A * 8/2000 Barresi ..... 211/206

* cited by examiner

*Primary Examiner*—Leslie A. Braun
*Assistant Examiner*—Gwendolyn Baxter
(74) *Attorney, Agent, or Firm*—Frommer, Lawrence & Haug, LLP; Ronald R. Santucci

(57) ABSTRACT

The corner connector is used to attach a horizontal shelf above the horizontal cross-bar of a garment rack. The corner connector includes a body with a horizontal passageway formed therethrough and a vertical cylinder with a blind aperture. Arcuate arms terminating in clip portions extend upwardly from the body.

7 Claims, 3 Drawing Sheets

CORNER CONNECTOR FOR GARMENT RACKS

BACKGROUND OF THE INVENTION

1. Field of the Invention

The invention pertains to a clip for securing a shelf, particularly a shelf made of tubular steel or wire, above a garment rack.

2. Description of the Prior Art

In the prior art, garment racks of the type with a horizontal bar supported by vertical bars on both ends are known. It is likewise known to build a garment rack with an integral horizontal shelf thereabove, such as is disclosed in U.S. Design Pat. No. 304,528, entitled "Garment Rack" and issued on Nov. 14, 1989 to Handler et al. However, this horizontal shelf appears to be integral to the design and no ability is provided to add a horizontal shelf above the horizontal bar of a garment rack.

Other prior art includes U.S. Design Pat. No. 406,484 entitled "Hanger and Rack Device", issued on Mar. 9, 1999 to Wu; U.S. Design Pat. No. 316,342 entitled "Towel Rack", issued on Apr. 23, 1991 to Kee; and U.S. Design Pat. No. 164,500 entitled "Clothes Rack", issued on Jun. 14, 1951 to Ives.

OBJECTS AND SUMMARY OF THE INVENTION

It is therefore an object of this invention to provide an apparatus for attaching a horizontal shelf above the horizontal bar of a garment rack.

It is therefore a further object of this invention to provide such an apparatus which is economical to manufacture and simple to use.

These and other objects are attained by providing a plastic corner connector which includes a vertically downwardly pointing opening for engaging the vertical supports of a garment rack. Additionally, the clip includes a horizontal opening for supporting the horizontal hanger rod of the garment rack. The clip further includes upwardly extending arcuate arms for engaging and supporting a shelf.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
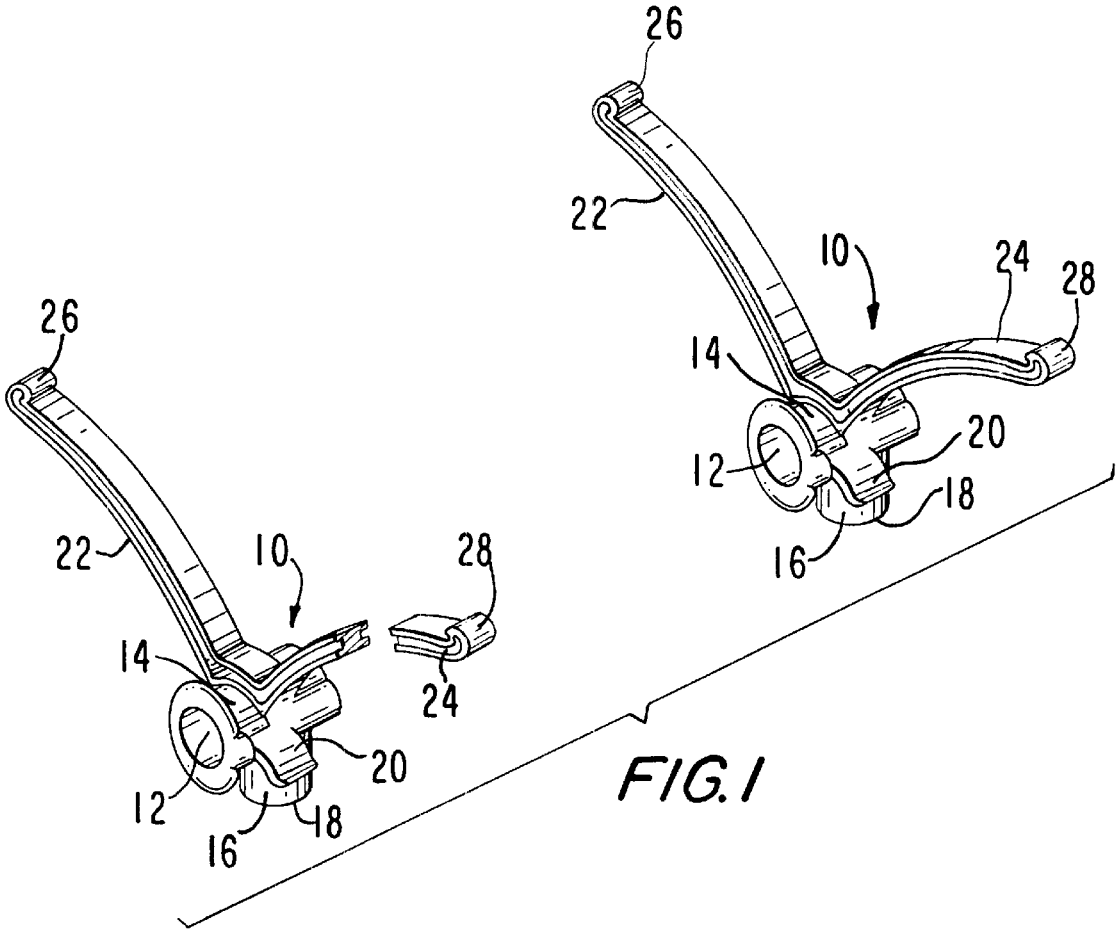
FIG. 1 is a perspective view of two corner connectors of the present invention.
Figure 2:
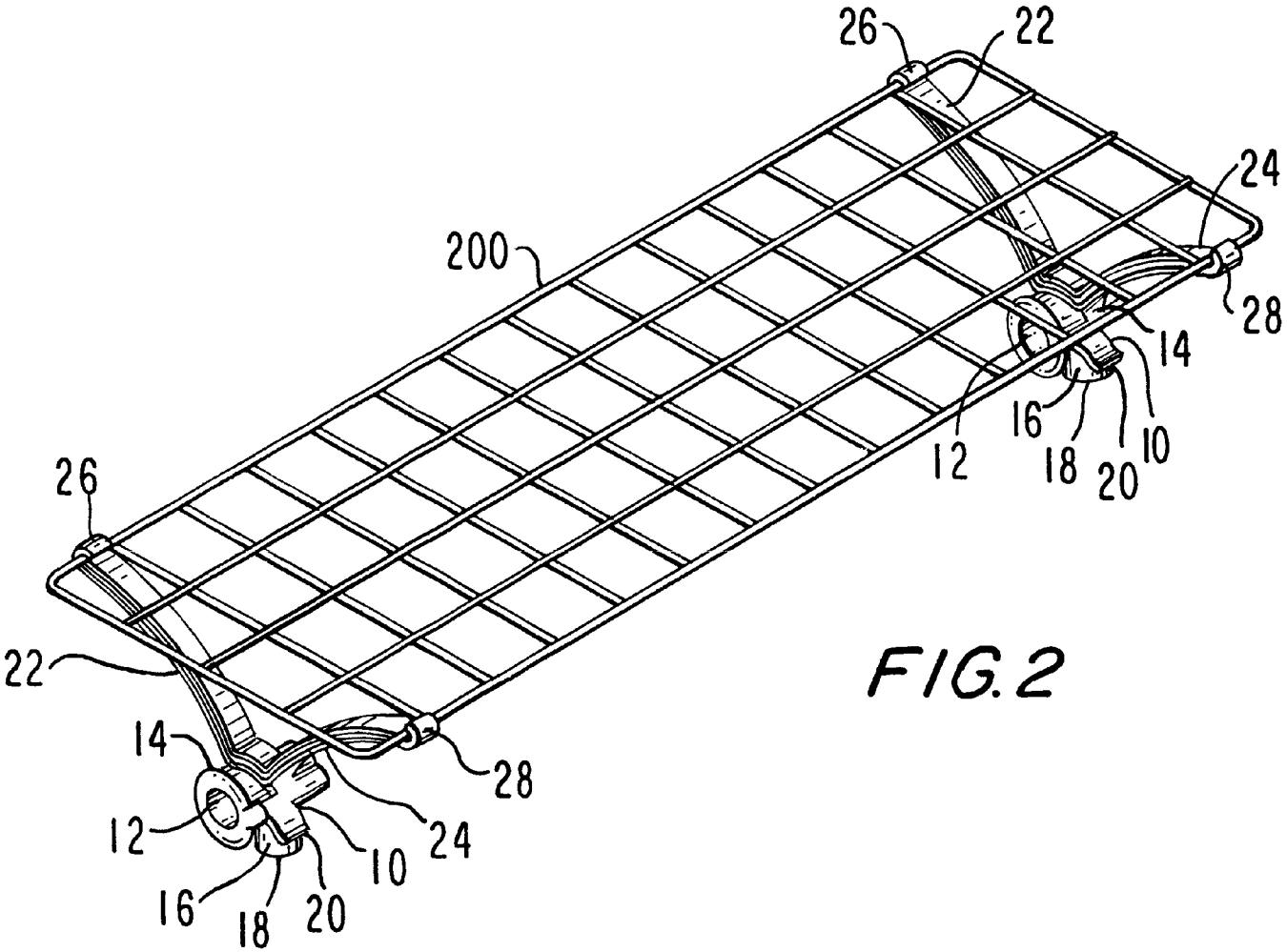
FIG. 2 is a perspective view of two corner connectors of the present invention engaging and supporting a shelf made of tubular steel or wire.

Referring now to the drawings in detail wherein like numerals refer to like elements throughout the several views, one sees that FIG. 1 is a perspective view of two of the corner connectors 10 of the present invention. FIG. 2 is a similar perspective view showing horizontal shelf 200 in place.

Figure 3:
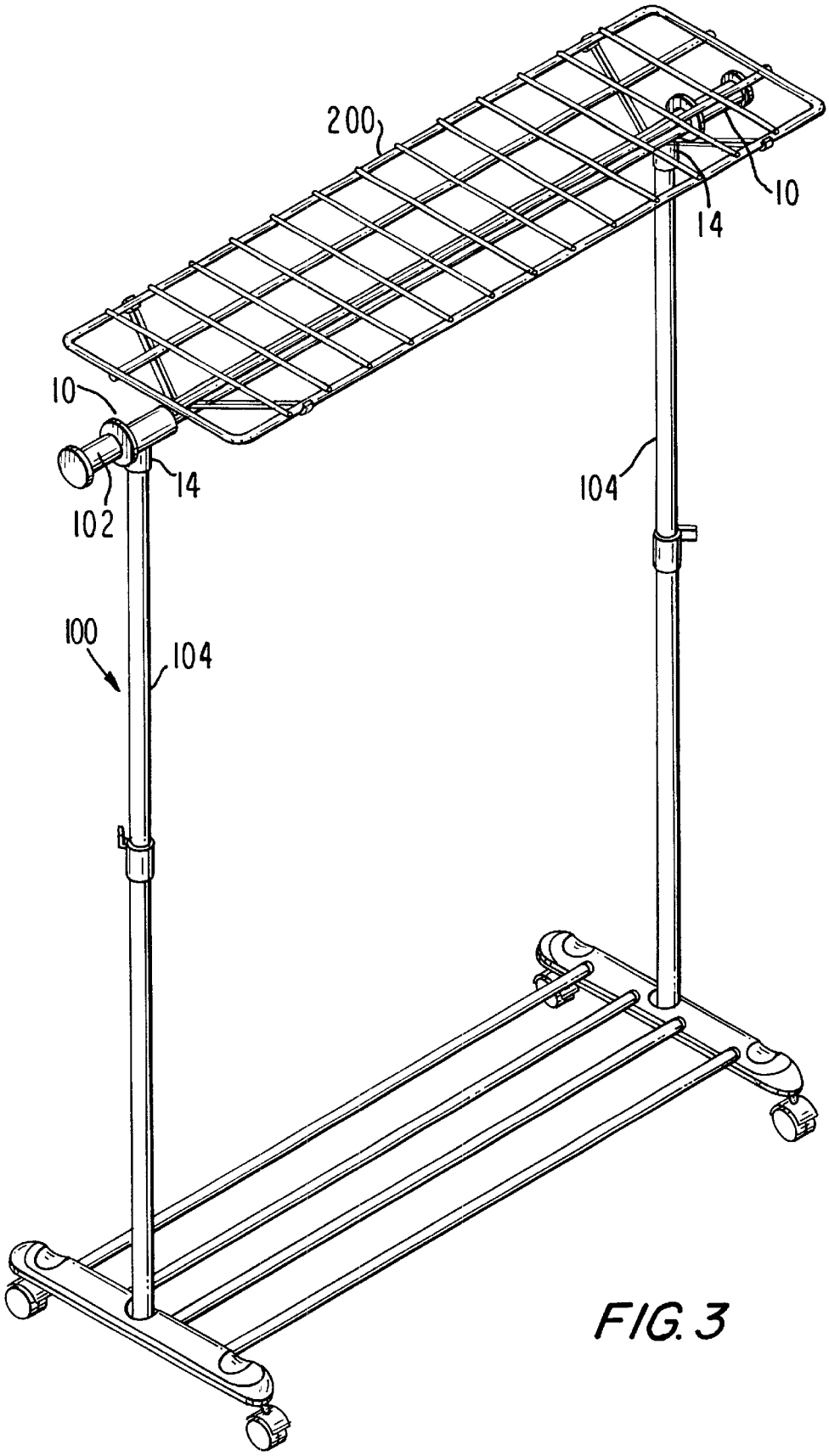
FIG. 3 is a perspective view of a garment rack using an alternative embodiment of the corner connector of the present invention.

Horizontal passageway 12 is formed through corner connector 10 and is intended to engage a horizontal cross-bar 102 of a garment rack 100 (see FIG. 3). Body 14 is formed around horizontal passageway 12. Cylinder 16 extends vertically downwardly from body 14 with blind aperture 18 formed therewithin and is intended to engage a vertical support bar 104 of a garment rack 100 (see FIG. 3). Arcuately downwardly extending lateral wings 20 are formed on the sides of body 14 and permit a user to have an improved grip for installing or removing corner connector 10.

Upwardly extending arcuate arms 22, 24 extend from body 14 and terminate in inwardly curled detent clips 26, 28, respectively. As shown in FIG. 2, detent clips 26, 28 engage and support horizontal shelf 200 which is formed of tubular steel or wire.

A slightly alternative version of corner clip 10 is illustrated in FIG. 3 wherein arms 22, 24 are straight, or at least less arcuate, and cylinder 16 is offset from the point where arms 22, 24 join body 14.

Corner clips 10 make it a relatively simple process to attach shelf 200 to garment rack 100.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A garment rack having at least two support members at a spaced distance from each other, wherein each support member comprises:

a body including means for receiving and supporting a horizontal cross bar which is extendable between the support members;

an opening in said body for receiving a vertical upright member; and arms extending upward and outward from said body with said arms terminating in means for fastening and supporting a detachable horizontal shelf therebetween.

2. A garment rack in accordance with claim 1, wherein said means for fastening and supporting are clips formed by turning the ends of the arms inward.

3. A garment rack in accordance with claim 2, wherein said arms are arcuately shaped.

4. A garment rack in accordance with claim 3, further including lateral wings formed on said body.

5. A garment rack in accordance with claim 1, wherein said means for fastening and supporting are clips formed by turning the ends of the arms inward.

6. A garment rack in accordance with claim 1, wherein said arms are arcuately shaped.

7. A garment rack having at least two support members at a spaced distance from each other, wherein each support member comprises:

a body;

an opening in said body for receiving a vertical upright member;

arms extending upward and outward from said body with said arms terminating in means for fastening and supporting a detachable horizontal shelf therebetween; and lateral wings formed on said body.

* * * * *